US010145386B2

(12) United States Patent
Oh

(10) Patent No.: US 10,145,386 B2
(45) Date of Patent: Dec. 4, 2018

(54) FAN MOTOR ASSEMBLY AND VACUUM CLEANER HAVING THE SAME

(71) Applicant: Samsung Electronics Co., Ltd., Suwon-si (KR)

(72) Inventor: Hyeon Joon Oh, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 636 days.

(21) Appl. No.: 14/578,931

(22) Filed: Dec. 22, 2014

(65) Prior Publication Data

US 2015/0184673 A1 Jul. 2, 2015

(30) Foreign Application Priority Data

Jan. 2, 2014 (KR) ..... 10-2014-0000463

(51) Int. Cl.

| | |
|---|---|
| ***F04D 29/44*** | (2006.01) |
| ***A47L 9/22*** | (2006.01) |
| ***A47L 5/22*** | (2006.01) |
| ***A47L 9/00*** | (2006.01) |

(52) U.S. Cl.

CPC ..... *F04D 29/441* (2013.01); *A47L 5/22* (2013.01); *A47L 9/0081* (2013.01); *A47L 9/22* (2013.01)

(58) Field of Classification Search

CPC ..... F04D 29/441; A47L 9/0081; A47L 9/22
USPC ..... 415/211.1
See application file for complete search history.

(56) References Cited

U.S. PATENT DOCUMENTS

| | | | | |
|---|---|---|---|---|
| 4,057,370 | A * | 11/1977 | Numata | F04D 25/082 415/119 |
| 6,232,696 | B1 * | 5/2001 | Kim | F04D 25/0653 310/156.37 |
| 7,334,987 | B2 * | 2/2008 | Oh | A47L 5/22 415/211.1 |
| 8,511,981 | B2 * | 8/2013 | Small | F04D 29/444 415/148 |
| 2010/0209271 | A1 * | 8/2010 | Yoo | A47L 5/22 417/423.2 |
| 2012/0199129 | A1 * | 8/2012 | Kenyon | A61M 16/0066 128/205.25 |

OTHER PUBLICATIONS

European Communication dated Sep. 20, 2017 in European Patent Application No. 14199031.7.

* cited by examiner

*Primary Examiner* — Aaron R Eastman
(74) *Attorney, Agent, or Firm* — Staas & Halsey LLP

(57) ABSTRACT

A fan motor assembly capable of improving efficiency of a motor by minimizing flow loss, and a vacuum cleaner having the same includes a case, a motor installed inside the case to form a suction force, an impeller rotatably installed on a shaft of the motor, and a guide fan configured to guide air that is suctioned by the motor, wherein the guide fan includes a first guide unit configured to increase pressure of the suctioned air and a second guide unit provided at an upper side of the first guide unit to be in contact with the case.

6 Claims, 8 Drawing Sheets

FAN MOTOR ASSEMBLY AND VACUUM CLEANER HAVING THE SAME

CROSS-REFERENCE TO RELATED APPLICATIONS

This application claims the priority benefit of the Korean Patent Application No. 10-2014-0000463, filed on Jan. 2, 2014, in the Korean Intellectual Property Office, the disclosure of which is incorporated herein by reference.

BACKGROUND

1. Field

The following description relates to a fan motor assembly capable of improving efficiency of a motor by minimizing loss in flow, and a vacuum cleaner having the same.

2. Description of the Related Art

In general, a vacuum cleaner is an apparatus capable of performing cleaning, after suctioning a foreign substance such as dust together with air by generating a suction force, by removing the foreign substance by use of a dust collecting apparatus provided inside a body of the vacuum cleaner.

The dust collecting apparatus configured to filter dust from the suctioned air is installed inside the body of the vacuum cleaner, and a fan motor assembly configured to generate a suction force to suction air is mounted at a rear of the dust collecting apparatus.

The fan motor assembly, by rotating a motor having a rotor configured to rotate with respect to a stator through an electromagnetic force when an external power is applied and by rotating an impeller installed at an upper portion of a shaft of the motor by a rotational force of the motor, is configured to suction outside air.

The fan motor assembly as such is configured to suction air to the inside of the vacuum cleaner at a fast flow speed through the impeller, and the suctioned air is guided to the inside by reducing the flow speed of the suctioned air by a guide fan.

Meanwhile, with respect to the guide fan formed by an injection process, an upper collar of a diffuser may have a deformity, such as a burr generated by an injection pressure, and flow loss may occur.

In addition, the flow loss may increase a variation in the performance of the motor and decrease the efficiency of the motor.

SUMMARY

Therefore, it is an aspect of the present disclosure to provide a fan motor assembly capable of improving efficiency of a motor by minimizing flow loss, and a vacuum cleaner having the same.

It is an aspect of the present disclosure to provide a fan motor assembly capable of improving the quality thereof by improving efficiency of a motor, and a vacuum cleaner having the same.

Additional aspects of the disclosure will be set forth in part in the description which follows and, in part, will be obvious from the description, or may be learned by practice of the disclosure.

In accordance with an aspect of the present disclosure, a fan motor assembly includes a case, a motor, an impeller, and a guide fan. The motor may be installed inside the case to form a suction force. The impeller may be rotatably installed at a shaft of the motor. The guide fan may be configured to guide air that is suctioned by the motor. The guide fan may include a first guide unit configured to increase pressure of the suctioned air, and a second guide unit provided at an upper side of the first guide unit to be in contact with the case.

The first guide unit may include a panel member having the shape of a circle, and a diffuser provided at the panel member.

The second guide unit may include a sealing member provided to prevent air flow from being generated between the second guide unit and the case.

The second guide unit may include a ring member having the shape of a ring, and a return vane formed to guide air having the pressure thereof increased by the first guide toward the motor.

The sealing member may include at least one rib protruding at an upper surface of the ring member.

The case may include a first case provided at an upper portion of the motor, and a second case provided at a lower portion of the motor, wherein the sealing member may be correspondingly formed as to make contact with a circumference of an upper surface of an inner side of the first case.

The panel member may be provided with a coupling groove correspondingly formed to be coupled to the second guide unit.

In accordance with an aspect of the present disclosure, a vacuum cleaner includes a body, and a fan motor assembly provided inside the body and configured to generate a suction force to suction outside air and dust, wherein the fan motor assembly may include a case, a motor, an impeller, and a guide fan. The motor may be installed inside the case to form a suction force. The impeller may be rotatably installed at a shaft of the motor. The guide fan may be configured to guide air that is suctioned by the motor. The guide fan may include a diffuser configured to increase the pressure of suctioned air, and a sealing member provided to make a line contact with the case at an upper side of the diffuser.

At least one rib may protrude from an upper surface of the sealing member.

The sealing member may include a return vane to guide air having the pressure thereof increased by the diffuser toward the motor.

The sealing member may include a ring member having the shape of a ring, and further include a first rib formed at one side of an upper surface of the ring member and a second rib protruding from the upper surface of the ring member while spaced apart from the first rib.

A coupling groove may be formed at an upper surface of the diffuser such that the return vane is coupled to the coupling groove.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
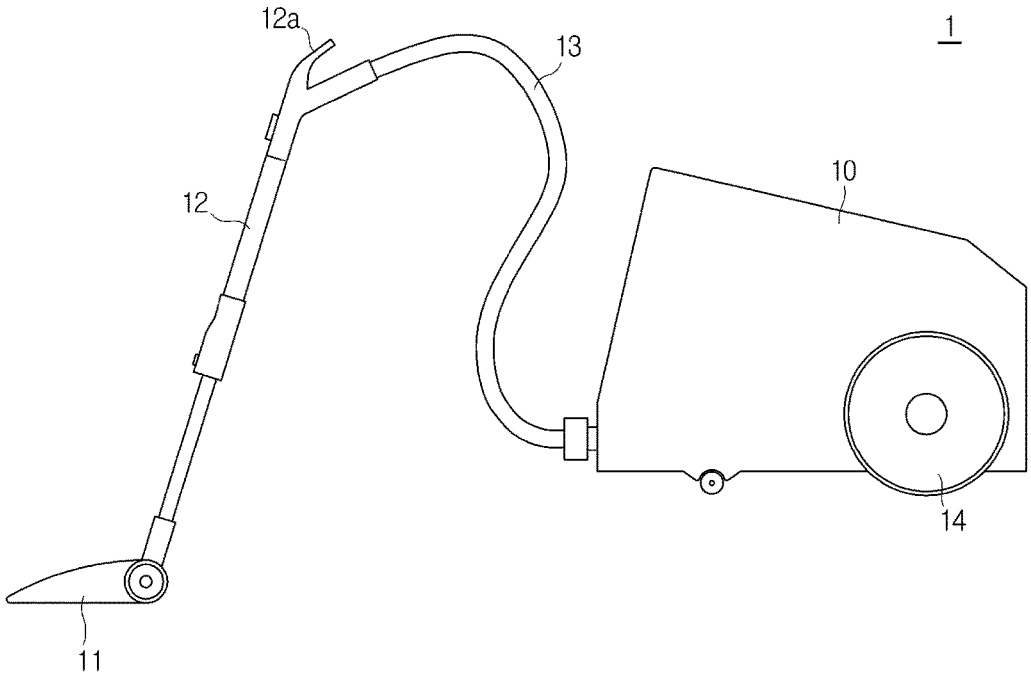
FIG. 1 is a drawing schematically showing a vacuum cleaner in accordance with an embodiment of the present disclosure.

Reference will now be made in detail to the embodiments of the present disclosure, examples of which are illustrated in the accompanying drawings, wherein like reference numerals refer to like elements throughout.

Figure 2:
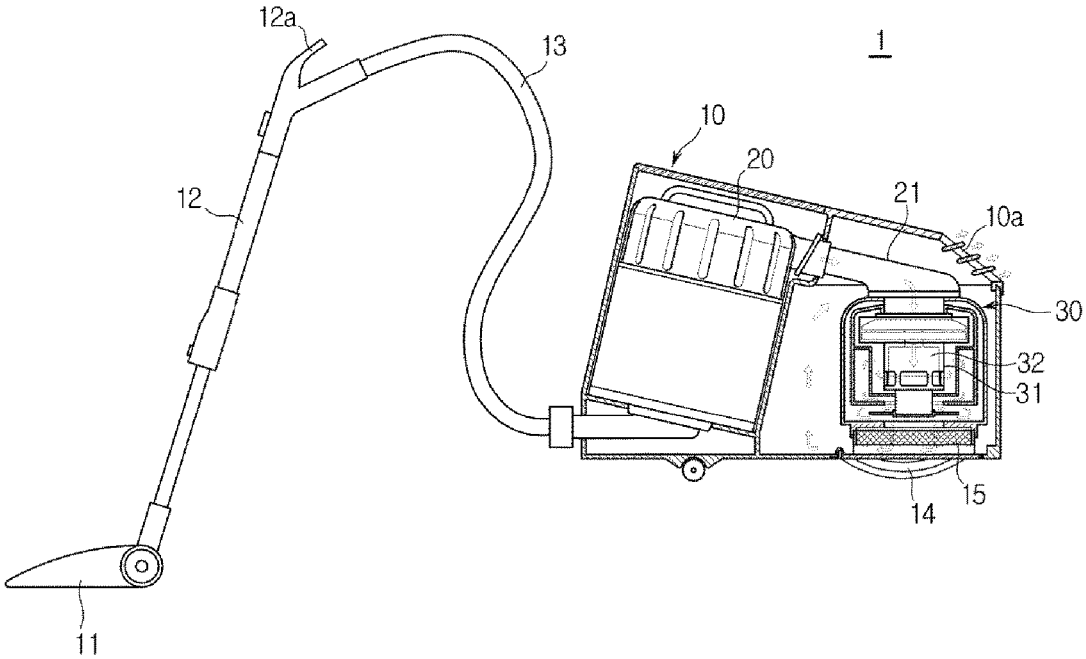
FIG. 2 is a drawing schematically showing a fan motor assembly installed at the vacuum cleaner in accordance with an embodiment of the present disclosure.
Figure 3:
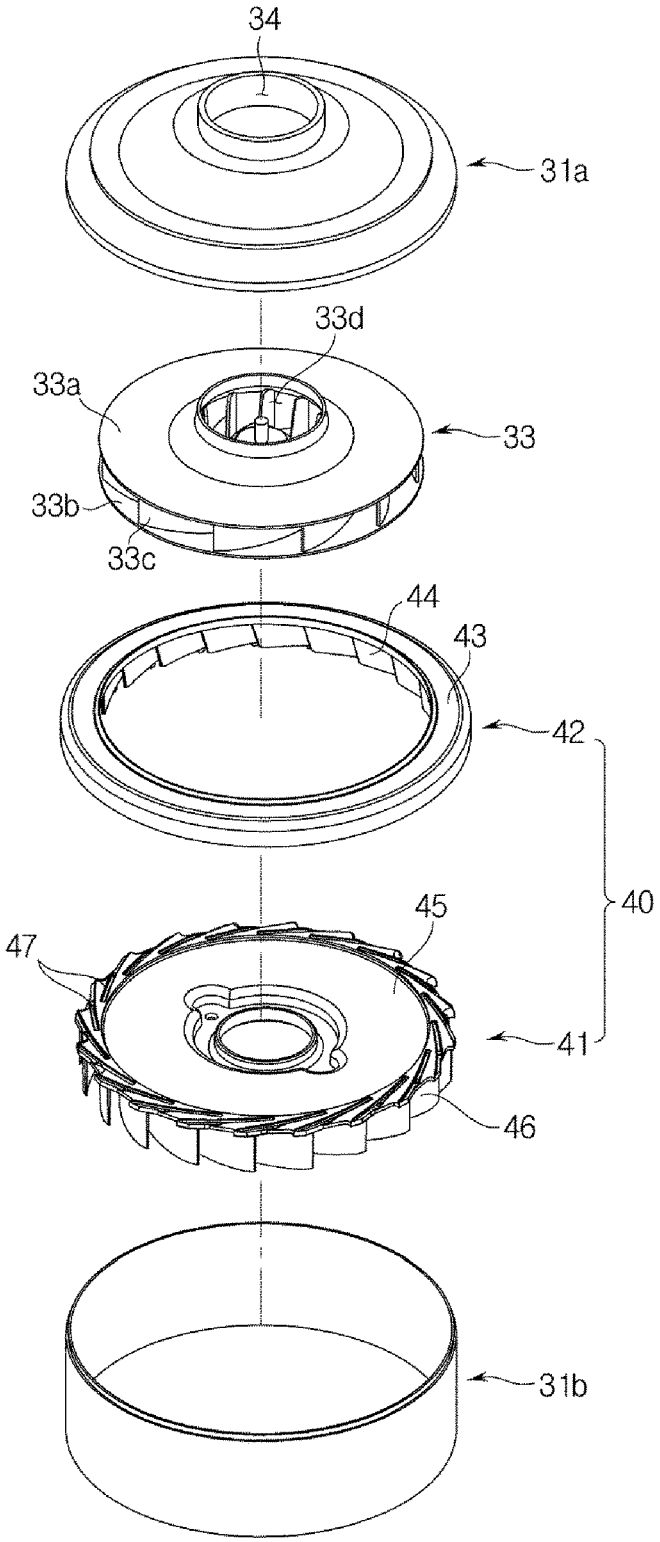
FIG. 3 is an exploded perspective view schematically showing the fan motor assembly in accordance with an embodiment of the present disclosure.

FIG. 1 is a drawing schematically showing a vacuum cleaner in accordance with an embodiment of the present disclosure, FIG. 2 is a drawing schematically showing a fan motor assembly installed at the vacuum cleaner in accordance with an embodiment of the present disclosure, and FIG. 3 is an exploded perspective view schematically showing the fan motor assembly in accordance with an embodiment of the present disclosure.

As illustrated on FIG. 1 to FIG. 3, a vacuum cleaner 1 includes a suction unit 11 provided to suction a foreign substance on a surface, such as a floor, to be cleaned, by use of a suction force, and a body 10 provided to collect the foreign substance that is taken in at the suction unit 11.

A connecting hose 13 and a connecting pipe 12 are connected between the body 10 and the suction unit 11 so that the suction force generated from the body 10 is delivered to the suction unit 11, and a handle 12*a* for a user may be provided between the connecting hose 13 and the connecting pipe 12.

The connecting hose 13 may be formed in the shape of a wrinkled pipe having flexibility, with one end thereof connected to the body 10 while the other end thereof is connected to the handle 12*a*, so that the suction unit 11 may be provided to freely move within a predetermined radius while having the body 10 as a center. The connecting pipe 12 is formed to have a predetermined length, with one end thereof connected to the suction unit 11 while the other end thereof is connected to the handle 12*a*, so that a user may be able to clean a foreign substance on a floor by moving the suction unit 11 while grabbing the handle 12*a*.

Driving wheels 14 symmetrically disposed at each sides of a lower surface of the body 10 may be provided. The driving wheels 14 are provided in a way that a user may be able to smoothly move the body 10.

The connecting hose 13 is connected to a front of the body 10 so that the suction air may be delivered, and an exhaust port 10*a* may be formed at a rear of the body 10 so that the air from which a foreign substance is filtered by use of an inside dust collecting unit 20 may be exhausted outside the body 10.

The dust collecting unit 20, and a fan motor assembly 30 provided to generate a suction force may be provided inside the body 10.

The fan motor assembly 30 includes a motor 32 installed inside a case 31 and provided to generate a suction force, an impeller 33 configured to rotate while installed on a shaft of the motor 32, and a guide fan 40 configured to guide the air that is suctioned by the motor 32.

The fan motor assembly 30 may be installed in a way that a rotational shaft is positioned vertically inside the body 10.

Meanwhile, an exhaust filter 15 configured to filter a foreign substance that is not filtered at the dust collecting unit 20 may be installed at a lower portion of the fan motor assembly 30.

In addition, a suction side 34 of the fan motor assembly 30 is connected to an exhaust side of the dust collecting unit 20 by a connecting pipe 21 to generate a suction force at the dust collecting unit 20.

The impeller 33 applied to the present disclosure is formed with a centrifugal fan configured to suction air toward an axis direction of the centrifugal fan and exhaust the suctioned air in a radial direction, and the air that is exhausted from the impeller 33 is exhausted to an outer side of the motor 32 after cooling the motor 32.

The case 31 includes a first case 31*a* provided at an upper portion of the motor 32, and a second case 31*b* provided at a lower portion of the motor 32 while coupled at a lower side of the first case 31*a*.

The motor 32 is provided with a rotor (not shown) and a stator (not shown), and the rotor is rotated in a case when a current is applied, while the rotation of the rotor is delivered to a motor shaft (not shown) to rotate the motor 32.

The rotation of the motor 32 is delivered to the impeller 33 that is fastened at an upper portion of the motor shaft.

The rotational motion of the impeller 33 is configured to provide a centrifugal force to the surroundings of the impeller 33, and by use of the centrifugal force, while air at the center of the impeller 33 is exhausted to an edge, or an outer side, of the impeller 33, the outside air of the suction side 34 may be taken in.

The impeller 33 is composed of an upper panel 33*a* and a lower panel 33*b* that are spaced apart from each other by a predetermined space while having the motor shaft as a concentric axis, and blades 33*c* are provided between the upper panel 33*a* and the lower panel 33*b*. The blades 33*c* are disposed between the upper panel 33*a* and the lower panel 33*b* in a radial direction while having a predetermined distance with respect to each other, and each blade 33*c* is formed in the shape of a curve having a predetermined curvature.

Meanwhile, an inlet path 33*d* of the air that is to be introduced by the rotational motion of the impeller 33 may be formed at a central portion of the upper panel 33*a*.

An example of the blades 33*c* of the impeller 33 that is applied to the present disclosure is illustrated in a way that the blades 33*c* are provided with a blade pattern that is spread in the radial shape of a spiral from a rotational center of the lower panel 33*b* toward an outer side direction, but the present disclosure is not limited hereto. The number and the curvature of the blades may be changed and formed in various ways as appropriate.

The guide fan 40 provided to guide the air that is taken in by the impeller 33 is arranged at an outer side of the impeller 33 while spaced apart from the impeller 33 by a predetermined distance, so that the impeller 33 may be rotated.

The guide fan 40 may include a first guide unit 41 configured to increase the pressure of suctioned air, and a second guide unit 42 provided at an upper side of the first guide unit 41.

Figure 4:
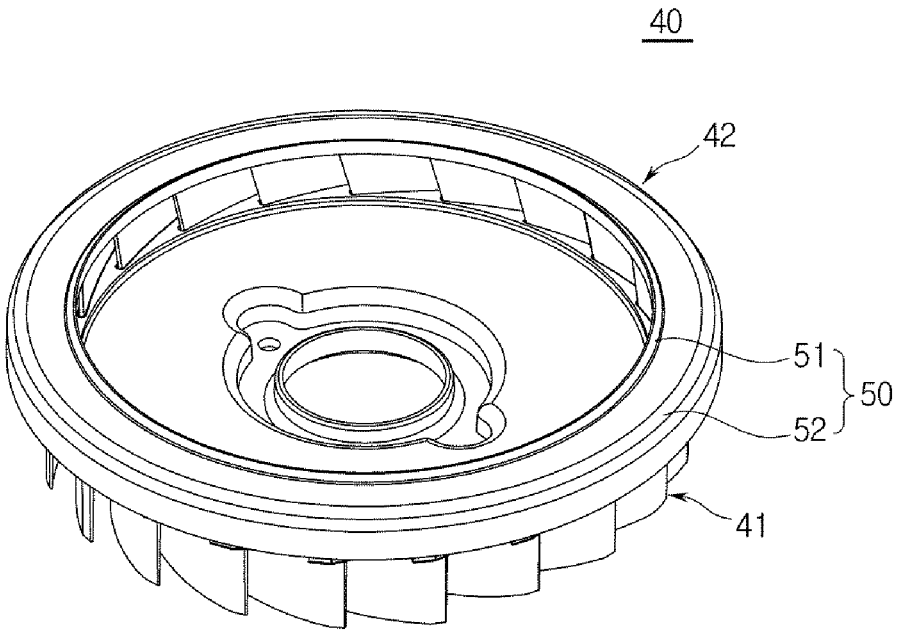
FIG. 4 is a perspective view schematically showing a guide fan of the fan motor assembly in accordance with an embodiment of the present disclosure.
Figure 5:
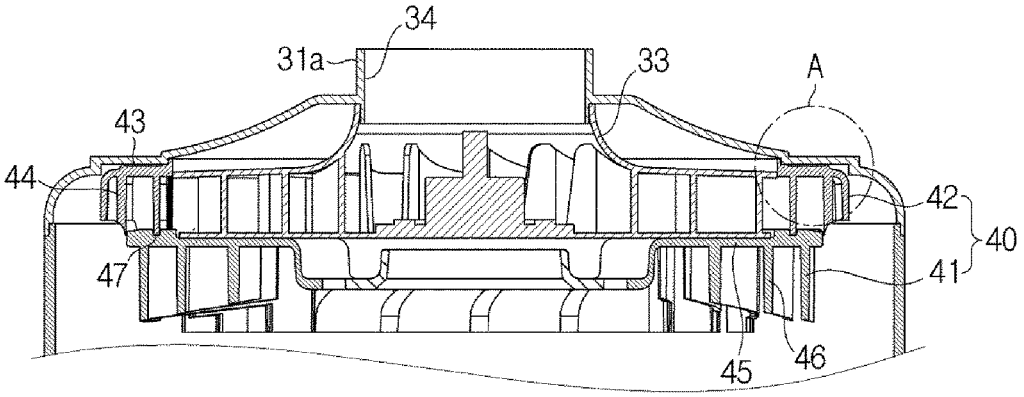
FIG. 5 is a cross-sectional view schematically showing the guide fan of the fan motor assembly in accordance with an embodiment of the present disclosure.
Figure 6:
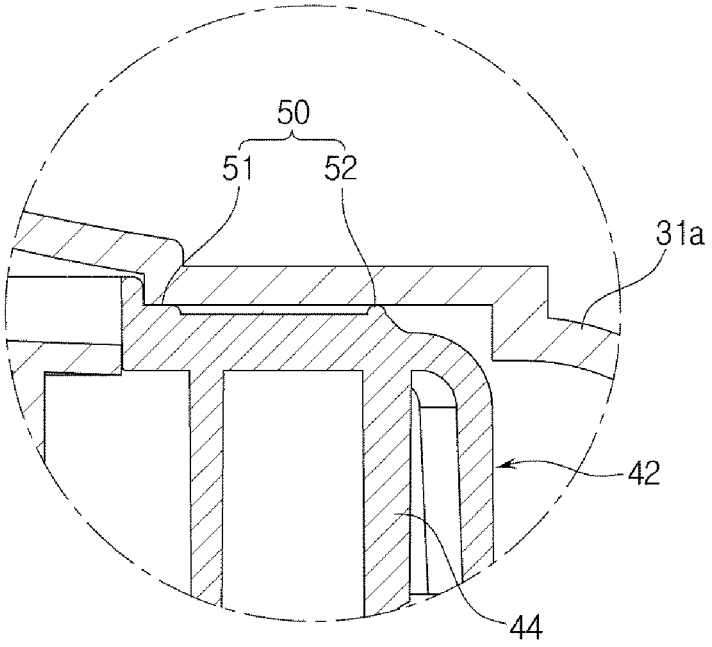
FIG. 6 is an enlarged view of a portion 'A' of FIG. 5.

FIG. 4 is a perspective view schematically showing the guide fan of the fan motor assembly in accordance with an embodiment of the present disclosure, FIG. 5 is a cross-sectional view schematically showing the guide fan of the fan motor assembly in accordance with an embodiment of the present disclosure, and FIG. 6 is an enlarged view of a portion 'A' of FIG. 5.

As illustrated on FIG. 4 to FIG. 6, the guide fan 40 of the fan motor assembly 30 includes the first guide unit 41 and the second guide unit 42 provided at an upper side of the first guide unit 41.

The case 31 may include a first case 31*a* provided at an upper portion of the motor 32, and a second case 31*b* provided at a lower portion of the motor 32 at a lower side of the first case 31*a*.

The first guide unit 41 may include a panel member 45 having the shape of a circle, and a diffuser 46 provided at a lower side of the panel member 45.

The diffuser 46 is provided to guide the air, which is suctioned through the suction side 34 at a fast speed by the rotation of the impeller 33, toward the motor 32.

The second guide unit 42 includes a ring member 43 having the shape of a ring, and a return vane 44 formed to guide the air provided with the pressure that is increased by the diffuser 46 of the first guide unit 41 toward the motor 32.

In addition, the second guide unit 42 includes a sealing member 50 configured to make a line contact with respect to the case 31 to prevent an air flow from occurring in between the second guide unit 42 and the case 31.

The sealing member 50 may include ribs 51 and 52 protruding from an upper surface of the ring member 43. The ribs 51 and 52 may be formed in a way to make contact with a circumference of an upper side of an inner side surface of the first case 31*a* forming an upper portion of the case 31.

The ribs 51 and 52 may include the first rib 51 formed around a circumference of an inner side of the ring member 43, and the second rib 52 formed around a circumference of an outer side of the ring member 43.

An example of the ribs 51 and 52 of the present disclosure is illustrated in a way that the ribs 51 and 52 are disposed at an inner side portion and an outer side portion of an upper surface of the ring member 42, respectively, but the present disclosure is not limited hereto. For example, the number of the ribs may be formed in a variable manner according to the size of the ring member and the shape of the case.

The first guide unit 41 is coupled to the second guide unit 42 to be separated through coupling grooves 47 that are formed in a recessed manner on an upper surface of the panel member 45 of the first guide unit 41.

Thus, when an external power is supplied to the motor 32, a rotational force is delivered to the impeller 33 by the rotational motion of the motor 32, and the impeller 33 suctions outside air at the surroundings of the suction side 34 while the impeller 33 is rotated, and then the air is suctioned through a centrifugal force of the impeller 33 and is exhausted toward an edge of the impeller 33. The air being exhausted from the impeller 33 is guided toward the motor 32 through the diffuser 46 of the first guide unit 41.

At this time, the sealing member 50 of the second guide unit 42 may be able to prevent flow loss of air by making a line contact with an inner side of the first case 31.

Figure 7:
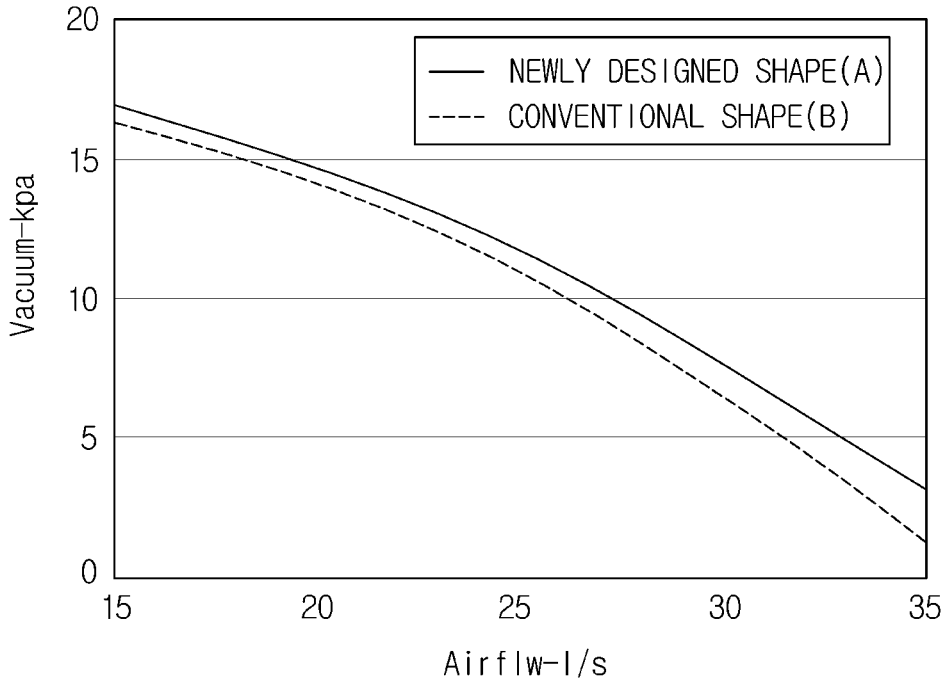
FIG. 7 is a graph showing vacuum level according to flow change when the guide fan of the fan motor assembly in accordance with an embodiment of the present disclosure is applied.
Figure 8:
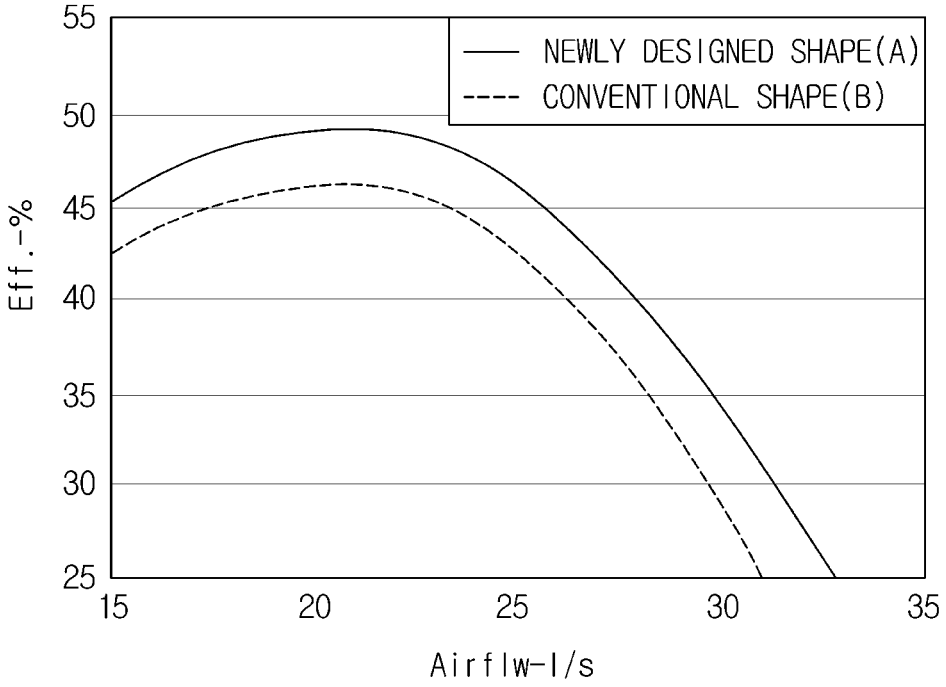
FIG. 8 is a graph showing efficiencies according to flow change when the guide fan of the fan motor assembly in accordance with an embodiment of the present disclosure is applied.

FIG. 7 is a graph showing vacuum level according to flow change when the guide fan of the fan motor assembly in accordance with an embodiment of the present disclosure is applied, and FIG. 8 is a graph showing efficiencies according to flow change when the guide fan of the fan motor assembly in accordance with an embodiment of the present disclosure is applied.

According to the result of a simulation test on the vacuum level and the efficiencies with respect to the structure (A) to which the guide fan 40 of the fan motor assembly 30 in accordance with the an embodiment of the present disclosure is applied, and the structure (B) to which the guide fan 40 not provided with the sealing member 50 is applied, the structure (A) applied with the guide fan 40 of the present disclosure is confirmed to be provided with higher vacuum level and the efficiency when compared to the structure (B).

As is apparent from the above, the efficiency of a motor can be improved by minimizing air flow loss.

In addition, the quality of a vacuum cleaner can be improved by improving the efficiency of a motor.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A fan motor assembly, comprising:

a case;

a motor installed inside the case;

an impeller installed on a rotation shaft of the motor to suction air; and a guide fan configured to guide the suctioned air, wherein the guide fan comprises:

a first guide unit configured to increase a pressure of the suctioned air, and a second guide unit provided at a side of the first guide unit, and having a ring shape, the case comprises a first case provided to house the impeller and a second case provided to house the motor, and the second guide unit comprises at least one rib protruding from a surface of the second guide unit in a direction away from the motor, the at least one rib configured to contact the first case.

2. The fan motor assembly of claim 1, wherein:

the first guide unit comprises:

a panel member having a circular shape, and a diffuser provided at a lower side of the panel member.

3. The fan motor assembly of claim 2, wherein:

the panel member is provided with a coupling groove formed to be coupled to the second guide unit.

4. The fan motor assembly of claim 1, wherein:

the second guide unit further comprises:

a return vane formed to guide the air having the increased pressure from the first guide unit toward the motor.

5. The fan motor assembly of claim 4, wherein the at least one rib is formed to make contact with a circumference of a surface of an inner side of the first case.

6. A fan assembly for minimizing air flow loss, the fan assembly comprising:

a case including a first case and a second case;

a rotatable impeller provided in the first case to exhaust suctioned air in a radial direction; and a guide fan configured to guide the exhausted air from the rotatable impeller, wherein the guide fan comprises:

a first guide unit configured to increase a pressure of the exhausted air, and a second guide unit having a ring shape and provided at a side of the first guide unit, and including at least one rib protruding from a surface of the second guide unit in a direction away from the motor and configured to contact an inner side of the first case.

* * * * *